US010317138B2

(12) United States Patent
Crondahl et al.

(10) Patent No.: US 10,317,138 B2
(45) Date of Patent: Jun. 11, 2019

(54) BAFFLE SYSTEMS AND METHODS OF REPLACING BAFFLE SEAL STRIPS

(71) Applicant: Westmill Industries Ltd., Aldergrove (CA)

(72) Inventors: Michael Crondahl, Mission (CA); Christian Gollmann, Eugene, OR (US)

(73) Assignee: Westmill Industries Ltd., Aldergrove (CA)

( * ) Notice: Subject to any disclaimer, the term of this patent is extended or adjusted under 35 U.S.C. 154(b) by 385 days.

(21) Appl. No.: 15/178,394

(22) Filed: Jun. 9, 2016

(65) Prior Publication Data

US 2016/0363370 A1 Dec. 15, 2016

Related U.S. Application Data

(60) Provisional application No. 62/174,119, filed on Jun. 11, 2015.

(51) Int. Cl.

| | |
|---|---|
| ***E06B 9/52*** | (2006.01) |
| ***F26B 25/00*** | (2006.01) |
| ***F26B 15/12*** | (2006.01) |

(52) U.S. Cl.

CPC ..... *F26B 25/008* (2013.01); *F26B 15/12* (2013.01); *F26B 25/004* (2013.01); *F26B 2210/14* (2013.01)

(58) Field of Classification Search

CPC ..... F26B 25/008; F26B 2210/14
USPC ..... 34/92; 160/13, 130, 236, 185, 215; 52/457, 458

See application file for complete search history.

(56) References Cited

U.S. PATENT DOCUMENTS

| | | | | |
|---|---|---|---|---|
| 2,963,001 | A | 12/1960 | Alexander | |
| 4,199,155 | A | 4/1980 | Day et al. | |
| 5,168,915 | A * | 12/1992 | Lafleur | E06B 3/485 160/201 |
| 7,931,750 | B2 | 4/2011 | Coolen et al. | |
| 8,857,074 | B2 | 10/2014 | Bernon et al. | |
| 2009/0211723 | A1 | 8/2009 | Attwenger | |
| 2016/0097592 | A1* | 4/2016 | Crondahl | F26B 21/02 34/487 |

FOREIGN PATENT DOCUMENTS

| | | |
|---|---|---|
| DE | 7825073 | 2/1979 |
| DE | 102004017812 A1 | 11/2005 |
| EP | 0732280 A1 | 9/1996 |
| EP | 1593776 A1 | 9/2005 |

* cited by examiner

*Primary Examiner* — John P McCormack
(74) *Attorney, Agent, or Firm* — Oyen Wiggs Green & Mutala LLP

(57) ABSTRACT

Baffle systems for conveyor-type dryers and methods of replacing baffle seal strips for improving dryer safety and/or efficiency are provided. The systems include one or more baffles removeably mounted to the dryer. Each baffle has at least one seal strip for contacting a roller of the dryer to prevent gases from entering and/or exiting the dryer. The baffles are removable from the dryer so that the seal strips can be replaced and/or adjusted when the seal between a given seal strip and a contacting roller become compromised. To replace and/or adjust a seal strip, the baffle is removed from the dryer and a new baffle is installed in its place. The one or more seal strips of the removed baffle may be replaced and/or adjusted outside the dryer at the leisure of the operator.

19 Claims, 5 Drawing Sheets

BAFFLE SYSTEMS AND METHODS OF REPLACING BAFFLE SEAL STRIPS

CROSS-REFERENCE TO RELATED APPLICATIONS

This application claims the benefit of and convention priority from U.S. patent application No. 62/174,119 entitled REMOVABLE BAFFLE SYSTEMS FOR WOOD VENEER DRYERS AND METHOD OF REPLACING OR ADJUSTING BAFFLES OF SAME and filed on 11 Jun. 2015 which is hereby incorporated herein by reference for all purposes.

TECHNICAL FIELD

The present invention relates to baffle systems for conveyor-type dryers and methods of replacing baffle seal strips.

BACKGROUND OF INVENTION

Single and multiple deck conveyor dryers for reducing the moisture content of sheet materials, including green (i.e. wet) wood veneer, wherein the material being dried is conveyed through a stationary drying chamber while heated gases are circulated through the drying chamber, are well-known in the art. Evaporation of moisture from the material being dried causes a build-up of steam within the dryer and creates a positive pressure differential within the dryer relative to the external atmosphere. Disposal of large amounts of gases containing volatile organic compounds (V.O.C.) which are evolved from the wood veneer during drying has been a major problem in the wood veneer drying art. Typically, gases are removed by an exhaust system and, in some systems, are exhausted directly to the atmosphere. By allowing gases to be exhausted directly to the atmosphere, pollutants have been allowed to escape and considerable quantities of heat energy are lost which is a considerable cost expense.

It is desirable to control the exhaust of gases from a wood veneer dryer to optimize the drying efficiency of the dryer and to provide a means for containing and treating the exhaust gases prior to discharge into the atmosphere. Such means include installing a V.O.C. separating device such as a catalytic or thermal oxidizer in the exhaust system. Such devices are well-known in the art.

If the drying process is not carefully controlled and optimized, untreated gases (i.e. gases containing V.O.C.) within a dryer will be discharged through not only the exhaust system, but through input and output ends of the dryer due to the positive pressure differential within the dryer. This presents real environmental concerns and health and safety hazards to workers. Prior art dryers have other disadvantages, including a loss of efficiency due to the entrance of air at ambient temperature into the dryer through input and output ends if a negative pressure differential is created within the dryer relative to the external atmosphere if gases are exhausted too quickly. Entrance of cooler ambient air reduces the temperature of the dryer, wasting a considerable amount of energy to reheat the dryer and resulting in pitch (i.e. condensed V.O.C. material) build-up within the dryer. This is an obvious fire hazard. Attempts have been made to control the inflow and outflow of gases through the input and output ends of wood veneer dryers using stop-offs or baffles. An example of one such attempt to improve wood veneer dryer efficiency and safety is disclosed in U.S. Pat. No. 4,439,930. However, with use, the stop-offs or baffles wear and the inflow and outflow of gases from the input and output ends of the dryer increases. To replace or adjust the worn stop-offs or baffles, the operator is required to stop operation of the wood veneer dryer to gain access to the stop-offs or baffles inside the dryer once the dryer has cooled. To access the worn stop-offs or baffles, one or more of dryer rollers, jet tubes, and conveyor chains of the dryer must be removed. Typically, about three operators are required to then remove the heavy stop-off or baffle. The process to replace or adjust worn stop-offs or baffles typically takes approximately 16 to 20 hours. The time the dryer spends in repair and/or is otherwise nonoperational, the required manpower, and the energy required to return a dryer to wood veneer drying temperatures, present significant costs.

There is accordingly a need in the art for a wood veneer dryer wherein the inflow of cooler ambient air into the dryer and/or the outflow of gases from inside the dryer are controlled to reduce energy consumption by the dryer, prevent the build-up of pitch within the dryer, and/or prevent the outflow of gases containing V.O.C. from the dryer before treatment in the exhaust system.

The foregoing examples of the related art and limitations related thereto are intended to be illustrative and not exclusive. Other limitations of the related art will become apparent to those of skill in the art upon a reading of the specification and a study of the drawings.

SUMMARY OF THE INVENTION

The following embodiments and aspects thereof are described and illustrated in conjunction with systems, tools, and methods which are meant to be exemplary and illustrative, not limiting in scope. In various embodiments, one or more of the above-described problems have been reduced or eliminated, while other embodiments are directed to other improvements.

To address the foregoing, the present invention provides removable baffle systems to mechanically seal a dryer and substantially restrict the inflow and/or outflow of gases from the input and output ends of the dryer and/or various dryer chambers. Methods of replacing and adjusting a baffle seal strip are further provided by the invention to address the foregoing.

One aspect of the present invention provides a baffle system for use with a dryer. The dryer includes at least one roller for supporting and conveying a material to be dried therethrough. The baffle system includes at least one dryer tube and a baffle removeably mountable to each dryer tube. Each dryer tube extends laterally from a first dryer wall to a second dryer wall inside the dryer, perpendicularly to a direction of travel of the material to be dried through the dryer. Each baffle comprises a body and at least one seal strip removeably attached to an end of the body. Each seal strip is positioned in sealing engagement with at least one roller when the baffle is removeably mounted inside the dryer.

In some embodiments, the baffle includes a baffle tube extending lengthwise through the body for receiving the dryer tube and removeably mounting the baffle inside the dryer.

In some embodiments, the baffle rests on the dryer tube when the baffle is removeably mounted inside the dryer. The baffle may comprise at least one baffle guide for guiding the baffle along the dryer tube when the baffle is removed from and/or inserted into the dryer.

In some embodiments, each dryer tube is vertically-aligned at one or more of an input end of the dryer, an output end of the dryer, an input end of a dryer chamber, and an output end of a dryer chamber.

In some embodiments, each dryer tube is attached at a first end to the first dryer wall and extends at least halfway between the first dryer wall and the second dryer wall. The dryer tube may be attached at a second end to the second dryer wall.

In some embodiments, the baffle is insulated.

In some embodiments, the baffle system includes at least one dryer guide attached to the dryer for supporting and guiding each baffle when the baffle is inserted into and/or removed from the dryer.

In some embodiments, the at least one seal strip includes a first seal strip attached to a first end of the body. The at least one seal strip may further include a second seal strip attached to a second end of the body opposed to the first end.

In some embodiments, each dryer tube is positioned such that when the corresponding baffle is removeably mounted thereto the first seal strip is positioned in sealing engagement with the at least one roller of the dryer.

In some embodiments, each dryer tube is positioned between an upper pinch roll assembly of the dryer and a lower pinch roll assembly of the dryer such that when the corresponding baffle is removeably mounted thereto the first seal strip is positioned in sealing engagement with a lower pinch roller of the upper pinch roll assembly and the second seal strip is positioned in sealing engagement with an upper pinch roller of the lower pinch roll assembly.

Another aspect of the present invention provides a dryer comprising a baffle system. The dryer includes at least one roller for supporting and conveying a material to be dried therethrough. The baffle system includes at least one dryer tube and a baffle removeably mountable to each dryer tube. Each dryer tube extends laterally from a first dryer wall to a second dryer wall inside the dryer, perpendicularly to a direction of travel of the material to be dried through the dryer. Each baffle comprises a body and at least one seal strip removeably attached to an end of the body. Each seal strip is positioned in sealing engagement with at least one roller when the baffle is removeably mounted inside the dryer.

Another aspect of the present invention provides a baffle system for use with a dryer. The dryer includes at least one roller for supporting and conveying a material to be dried through the dryer. The baffle system includes at least one baffle removeably mountable to the dryer. Each baffle includes a body and at least one seal strip removeably attached to an end of the body. Each seal strip is positioned in sealing engagement with the at least one roller when the baffle is removeably mounted inside the dryer.

In some embodiments, each baffle is vertically-aligned at one or more of an input end of the dryer, an output end of the dryer, an input end of a dryer chamber, and an output end of a dryer chamber.

In some embodiments, each baffle is insulated.

In some embodiments, the baffle system includes at least one guide attached to the dryer for supporting and guiding each baffle when the baffle is inserted into or removed from the dryer.

In some embodiments, the at least one seal strip includes a first seal strip attached to a first end of the body. The at least one seal strip may include a second seal strip attached to a second end of the body opposed to the first end.

In some embodiments, each baffle is mountable inside the dryer such that the first seal strip is positioned in sealing engagement with the at least one roller of the dryer.

In some embodiments, each baffle is mountable inside the dryer such that the first seal strip is positioned in sealing engagement with a lower pinch roller of an upper pinch roll assembly of the dryer and the second seal strip is positioned in sealing engagement with an upper pinch roller of a lower pinch roll assembly of the dryer.

Another aspect of the present invention provides a dryer comprising a baffle system. The dryer includes at least one roller for supporting and conveying a material to be dried through the dryer. The baffle system includes at least one baffle removeably mountable to the dryer. Each baffle includes a body and at least one seal strip removeably attached to an end of the body. Each seal strip is positioned in sealing engagement with the at least one roller when the baffle is removeably mounted inside the dryer.

Another aspect of the present invention provides a method of replacing and/or adjusting a seal strip inside a dryer. The dryer includes at least one roller for supporting and conveying a material to be dried through the dryer. A first baffle is removed from the dryer by sliding the baffle through a manifold. A second baffle is inserted into the dryer by sliding the baffle through the manifold such that at least one seal strip of the second baffle is positioned in sealing engagement with the at least one roller of the dryer.

In some embodiments, the first baffle is removed from the dryer by removing a dryer tube from a first baffle tube of the first baffle and the second baffle is installed in the dryer by inserting the dryer tube into a second baffle tube of the second baffle.

In some embodiments, the first baffle is removed from the dryer by sliding the first baffle across a dryer tube inside the dryer and the second baffle is installed into the dryer by sliding the second baffle across the dryer tube.

In some embodiments, at least one seal strip is removed from the first baffle and at least one new seal strip is removeably attached to the baffle.

In some embodiments, the at least one seal strip is adjusted.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in referenced figures of the drawings. It is intended that the embodiments and figures disclosed are to be considered illustrative of the invention rather than restrictive.

DETAILED DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Unless context dictates otherwise, "input end" (as used herein in relation to a dryer and components thereof) means the end wherein a material to be dried is introduced into one or more of the dryer, an input end seal chamber, a drying chamber, an intermediary chamber, and a cooling chamber.

Unless context dictates otherwise, "output end" (as used herein in relation to a dryer and components thereof) means the end opposite to the input end, i.e. the end wherefrom a dried material exits one or more of the dryer, an input end seal chamber, a drying chamber, an intermediary chamber, and a cooling chamber.

Figure 2:
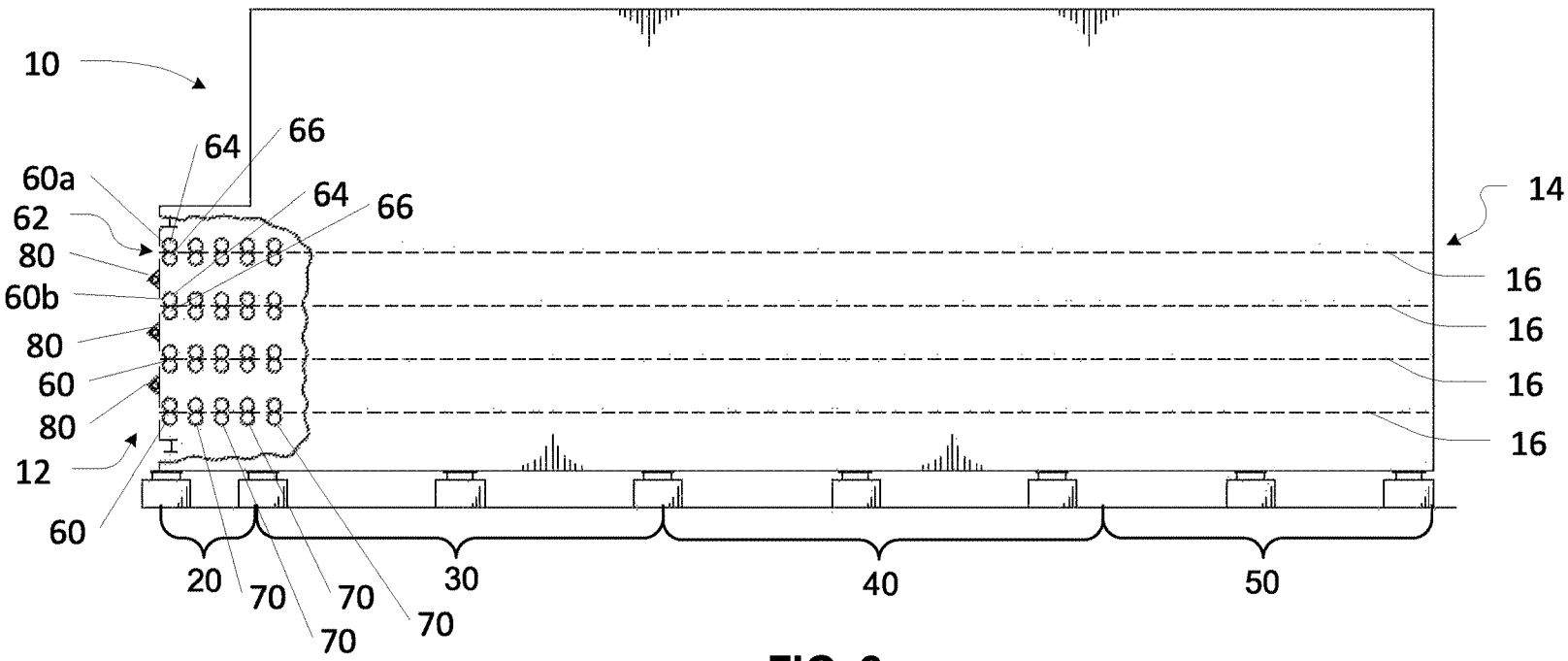
FIG. 2 is a fragmented side elevation view of the baffle system shown in FIG. 1.

Unless context dictates otherwise, "direction of travel" (as used herein) means a direction in which a material to be dried travels from an input end to an output end of a dryer, i.e. the direction from left to right in view of the example embodiment shown in FIG. 2.

Unless context dictates otherwise, "chamber" (as used herein) means one or more of a drying chamber, an intermediary chamber, and a cooling chamber.

Some embodiments of the present invention provide baffle systems and methods of replacing or adjusting worn seal strips for improving dryer safety and/or efficiency. The systems include one or more baffles removeably mounted to the dryer at one or more of an input end, an output end, an input end of a dryer chamber, and an output end of a dryer chamber. Each baffle has at least one seal strip for contacting a roller of the dryer to prevent gases from entering and/or exiting the dryer. The baffles are removable from the dryer so that the seal strips can be replaced and/or adjusted when the seal between a given seal strip and a contacting roller becomes compromised. To replace and/or adjust a seal strip, the baffle is removed from the dryer and a new baffle is installed in its place. Each seal strip of the new baffle contacts a dryer roller to prevent the inflow and outflow of gases. Thus, to replace and/or adjust a worn seal strip, normal operating conditions of the dryer need only be interrupted temporally since it takes an operator mere minutes to replace a worn baffle with a new baffle and the one or more seal strips of the removed baffle may be replaced and/or adjusted at the leisure of the operator, outside of the dryer. Also, the manpower required to replace the worn baffle with the new baffle and the energy required to return the dryer to normal operating conditions once the new baffle has been installed are minimal. Further still, dryer components, such as dryer rollers, jet tubes, and conveyor chains need not be removed from the dryer to access the worn baffle and install a new baffle.

A baffle system 100 in accordance with one example embodiment of the present invention is shown in FIGS. 1, 3, 4, and 5. System 100 may be installed for use with a variety of conveyor-type dryers, such as a wood veneer dryer 10 shown in FIGS. 1, 2, 4, and 5, having at least one roller for supporting and/or conveying a material to be dried through the dryer. Unless context dictates otherwise, "dryer" (as used herein) includes a variety of conveyor-type dryers and ovens, including, but not limited to, wood veneer dryers, gypsum dryers, textile dryers, industrial dryers, and glass ovens.

A conventional wood veneer dryer, such as dryer 10, may include an input end seal chamber 20 connected to an input end 12 of an elongated drying chamber 30 (see FIG. 2). A typical dryer may have several juxtaposed drying chambers 30. Green or undried sheets of wood veneer are introduced into dryer 10 at input end 12 of seal chamber 20. The wood veneer sheets pass longitudinally through dryer 10 from input end 12 to an output end 14. The wood veneer sheets may pass through one or more conventional intermediary chambers 40 attached to output end 14 of drying chamber 30 and conventional cooling chambers 50 attached at output end 14 of drying chamber 30 and/or at output end 14 of intermediary chamber 40 before exiting dryer 10.

As best seen in FIG. 2, dryer 10 includes at least one conveying pinch roll assembly 60 at input end 12 of input end seal chamber 20. Each conveying pinch roll assembly 60 supports a wood veneer sheet as it enters into and travels through dryer 10. Where dryer 10 includes more than one conveying pinch roll assembly 60, as in the example embodiment shown in FIG. 2, conveying pinch roll assemblies 60 are vertically-aligned. Dryer 10 may include one or more supporting pinch roll assemblies 70 horizontally-aligned with conveying pinch roll assembly 60. Each supporting pinch roll assembly 70, together with the corresponding conveying pinch roll assembly 60, defines a level or deck 16 (shown schematically in dotted lines) along which sheets of wood veneer are supported and conveyed. Each dryer chamber includes a similar arrangement of conveying and/or supporting pinch roll assemblies for supporting and conveying sheets of wood veneer. In the example embodiment shown in FIG. 2, dryer 10 includes four vertically-aligned conveying pinch roll assemblies 60, four supporting pinch roll assemblies 70 horizontally-aligned with each conveying pinch roll assembly 60, and four levels 16.

System 100 includes one or more baffles 80 removeably mounted to a dryer at one or more of an input end, an output end, an input end of a dryer chamber, and an output end of a dryer chamber depending on the demands of the dryer and/or the operator. Baffle system 100 (and each baffle 80) is sized and dimensioned to seal openings at the dryer input and/or output ends. In the example embodiment shown in FIGS. 1, 4, and 5, dryer 10 includes four levels 16 and system 100 includes five baffles 80 removeably mounted to dryer 10 at input end 12 of seal chamber 20 as described elsewhere herein to prevent gases from entering and/or escaping the dryer. Persons skilled in the art will recognize that the number of baffles 80 of baffle system 100 may depend on the number of levels 16 of a given dryer.

Figure 3:
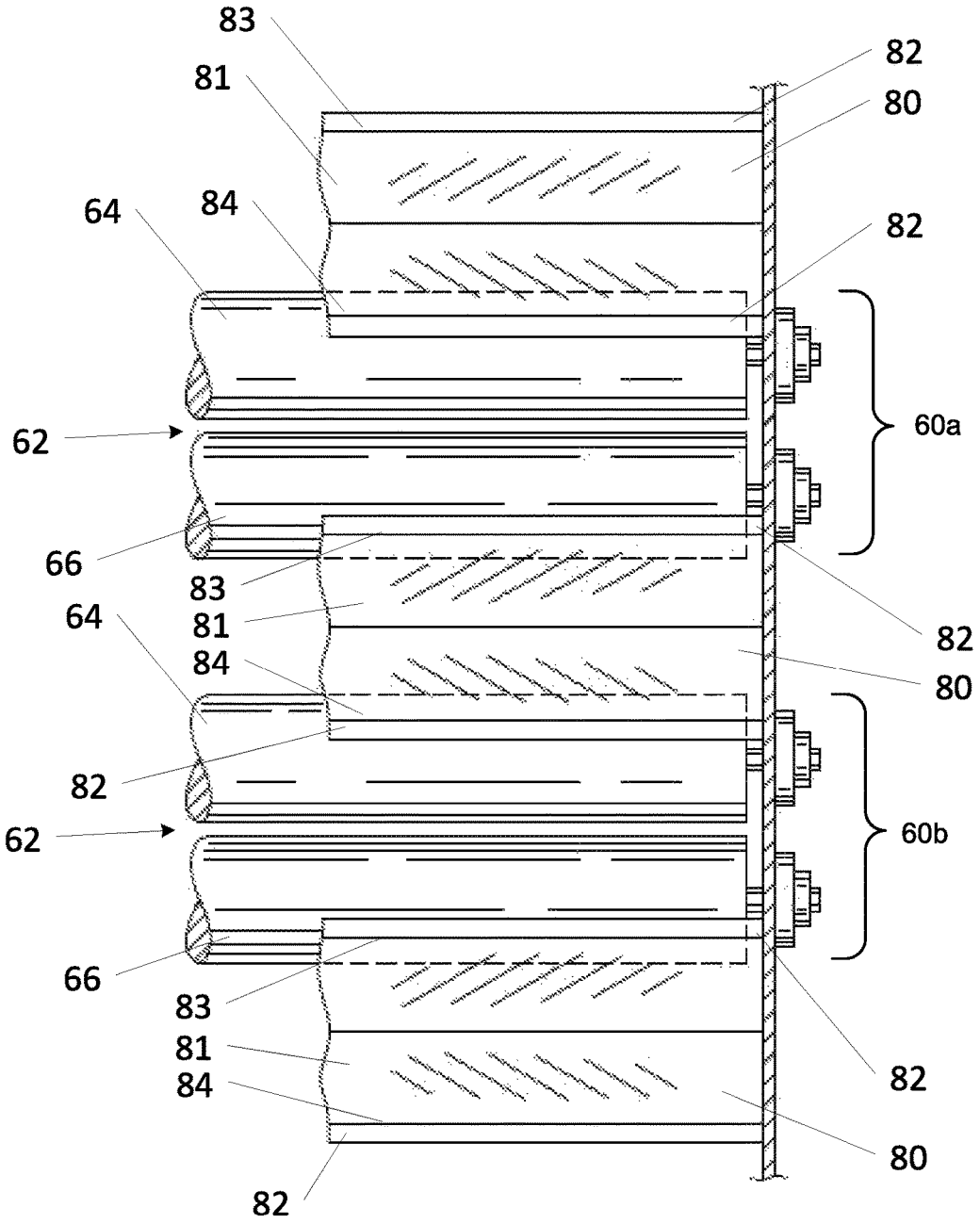
FIG. 3 is a partial front elevation view of the baffle system shown in FIG. 1.

Each baffle 80 includes a body 81 and one or more seal strips 82 removeably attached to body 81 for contacting a dryer roller to prevent gases from entering and/or escaping the dryer (see FIG. 3). In the example embodiment shown in FIGS. 1 to 5, baffle 80 includes a seal strip 82 removeably attached to an upper end 83 of body 81 and a seal strip 82 removeably attached to a lower end 84 of body 81 opposed to upper end 83. Each seal strip 82 contacts a roller of the dryer to seal air gaps that may exist, for example, between vertically-aligned rollers and/or pinch roll assemblies (see FIG. 2).

Figure 1:
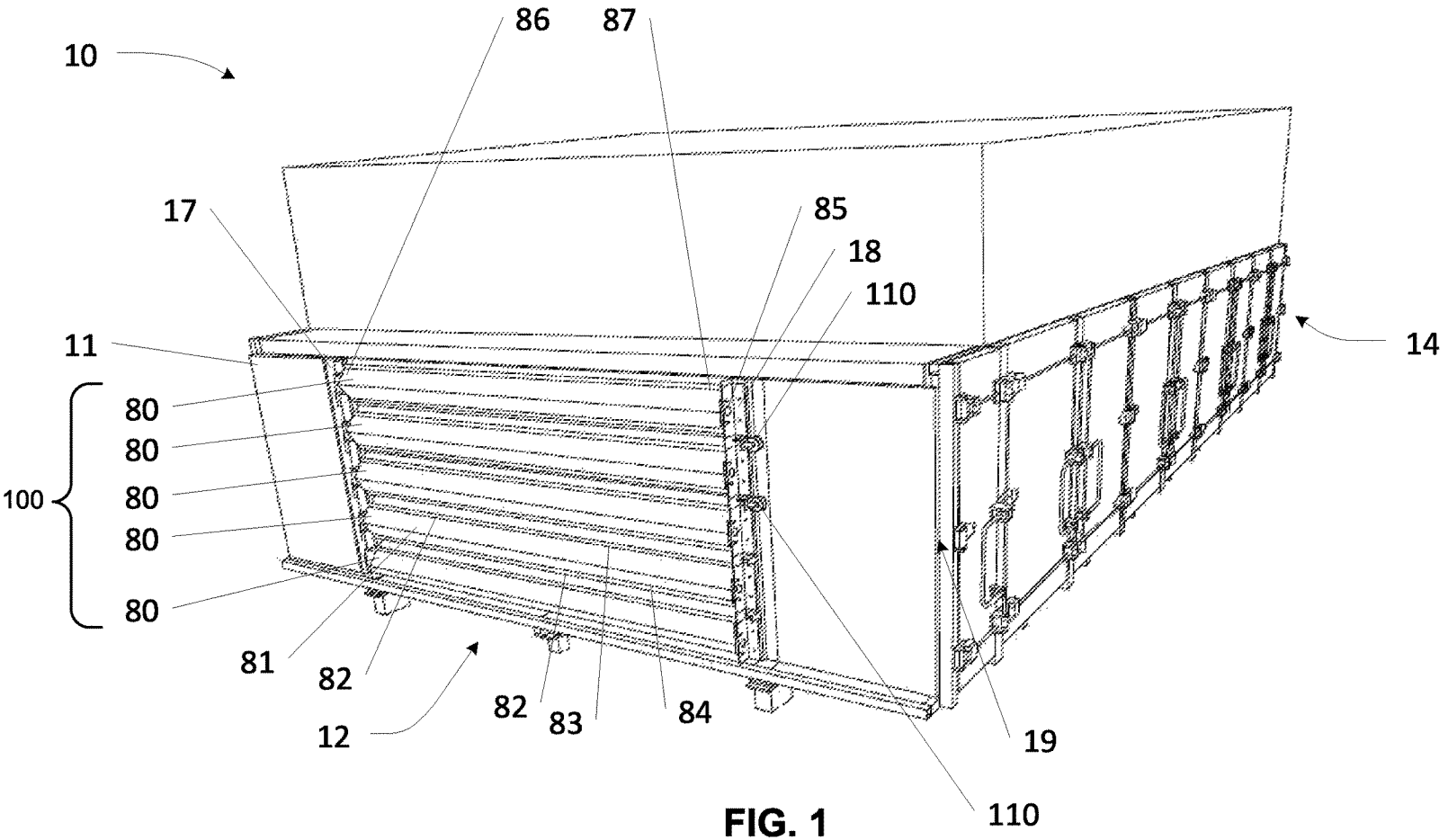
FIG. 1 is a perspective view of a baffle system according to an example embodiment, wherein the baffle system is installed in a wood veneer dryer.
Figure 4:
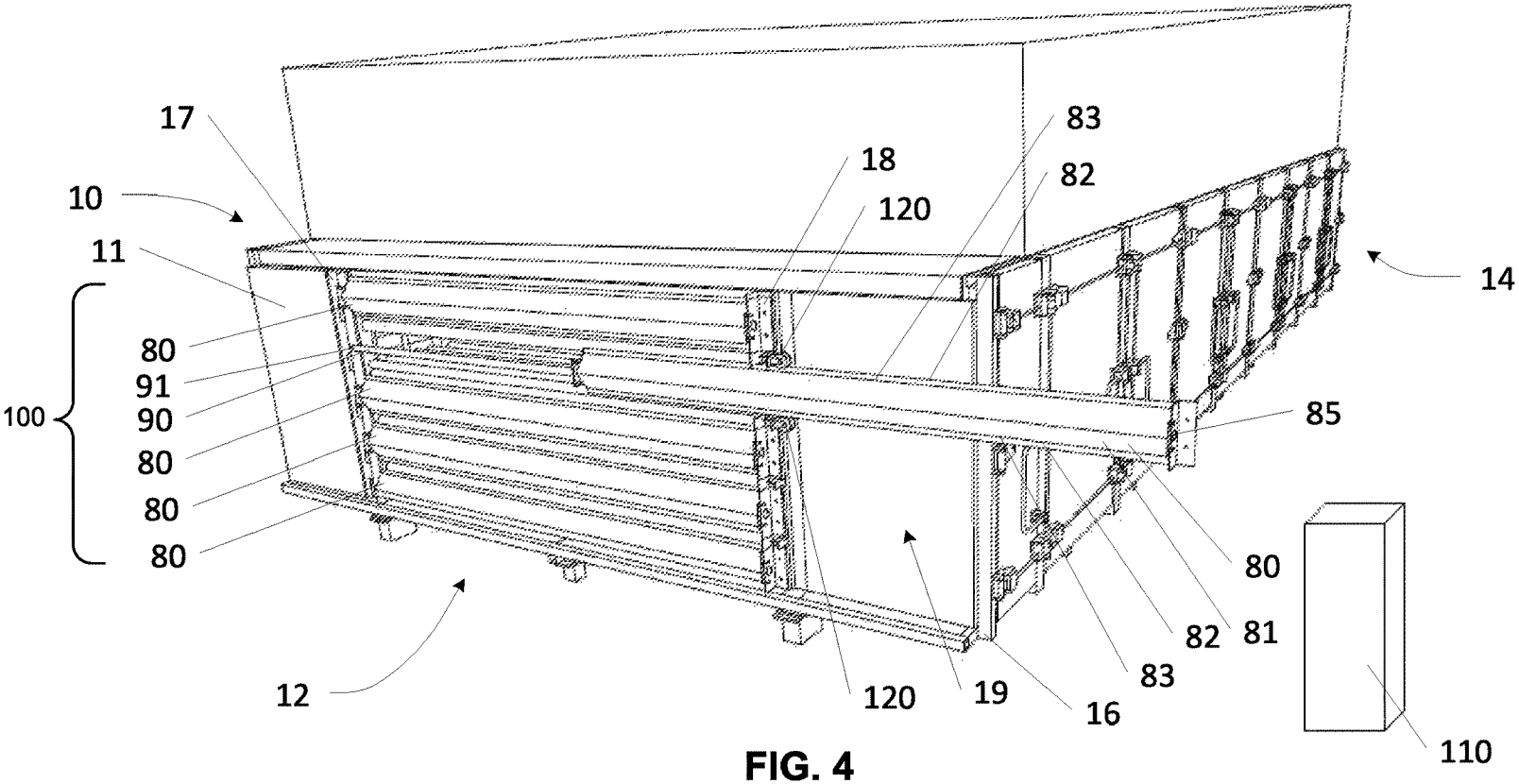
FIG. 4 is a perspective view of the baffle system shown in FIG. 1, wherein a baffle is partially removed from or partially installed in a wood veneer dryer.
Figure 5:
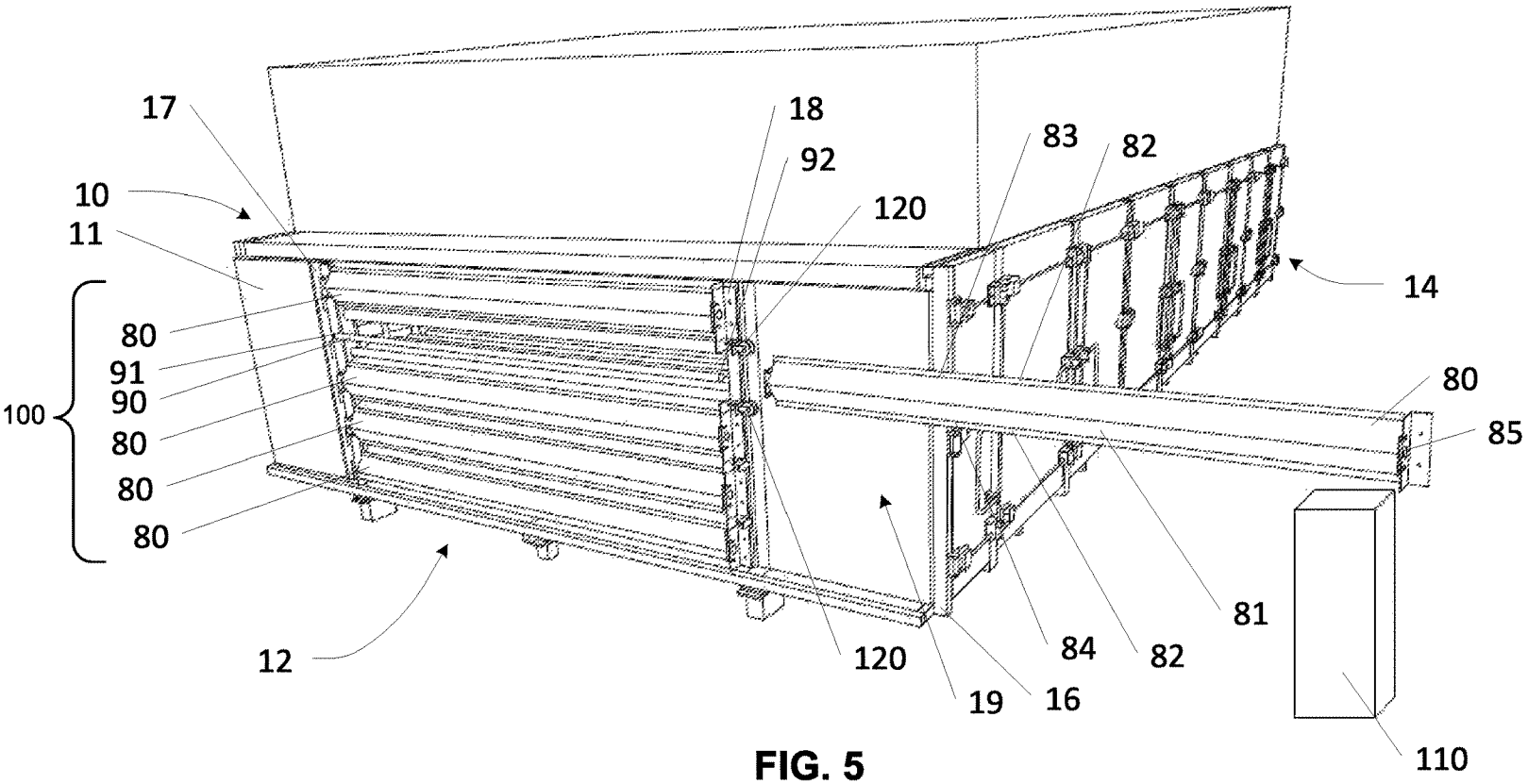
FIG. 5 is a perspective view of the baffle system shown in FIG. 1, wherein a baffle is completely removed from a wood veneer dryer.

Body 81 comprises an elongated shell that may define a tube 85 extending lengthwise through a middle of body 82 (see FIGS. 1, 4, and 5). Tube 85 may be used to removeably mount baffle 80 to a dryer as described elsewhere herein. Body 81 and/or tube 85 are made of a ferrous or non-ferrous material, including, but not limited to, one or more of steel and stainless steel. Colder temperatures outside a dryer would be conducted inside the dryer by body 81 causing pitch to condense and build-up on the colder surfaces of body 81. Accordingly, body 81 may be insulated. For example, the interior of body 81 is provided with an insulating material, including, but not limited to, one or more of a mineral wool and other insulating materials conventionally known.

Seal strip 82 is made of a flexible and/or durable material having a degree of heat resistance that is suitable for use in high temperature dryers, including, but not limited to, one or more of silicon, stainless steel, high temperature textiles (such as high temperature woven glass (e.g. woven glass blankets and woven glass cloth) and Nomex™ cloth), coated textiles (such as vermiculite-coated cloth, rubber-coated cloth, rubber-coated fibreglass cloth, neoprene-coated cloth, neoprene-coated fibreglass cloth), and impregnated high temperature textiles (such as graphite-impregnated high temperature textiles). Seal strip 82 may be removeably attached to body 81 of baffle 80 using one or more of bolts, clamps, or other means conventionally known.

To mount baffle 80 to a dryer, the dryer is provided with a tube 90 for each baffle 80 of system 100 at one or more of an input end, an output end, an input end of a dryer chamber, and an output end of a dryer chamber. In the example embodiment shown in FIGS. 4 and 5, tubes 90 are provided at input end 12 of seal chamber 20 of dryer 10. Where system 100 includes more than one baffle 80, the dryer is provided with a corresponding number of tubes 90, each tube 90 vertically-aligned with the other tubes. Tube 90 is attached at a first end 91 to a first dryer wall, such as dryer wall 17, and extends at least halfway from the first dryer wall to a second dryer wall, such as dryer wall 18, in a direction that is perpendicular to the direction of travel of a material to be dried through dryer 10. In some embodiments, a second end 92 of tube 90 is attached to the second dryer wall. In the example embodiment shown in FIGS. 4 and 5, each tube 90 is attached at first end 91 to first dryer wall 17 and at second end 92 to second dryer wall 18. Baffle 80 is removeably mounted to tube 90 by inserting tube 90 through tube 85 of baffle 80. In some embodiments, baffle 80 rests on tube 90 (not shown) and is inserted into and/or removed from a dryer by sliding the baffle across tube 90. Baffle 80 may include at least one guide (not shown) at lower end 84 to assist movement of baffle 80 across tube 90.

Each tube 90 is positioned such that when baffle 80 is removeably mounted thereto or thereon, seal strip 82 contacts a roller of the dryer. In the example embodiment shown in FIGS. 2 and 3, each tube 90 is positioned between an upper pinch roll assembly 60*a* and a lower pinch roll assembly 60*b* such that when baffle 80 is removeably mounted to tube 90 the upper seal strip 82 of baffle 80 is positioned in sealing engagement with a lower pinch roller 66 of upper pinch roll assembly 60*a* and the lower seal strip 82 of baffle 80 is positioned in sealing engagement with an upper pinch roller 64 of a lower pinch roll assembly 60*b*. The air seal established between seal strips 82 and the respective roller permits upper pinch roller 64 to move relative to baffle 80 as sheets of a material to be dried enter nip 62 and pass through the pinch rollers of a given pinch roll assembly 60. Lower pinch roller 66 is fixed and upper pinch roller 64 allowed to move upwardly as the material enters nip 62. Reference numerals 60*a* and 60*b* are used herein to respectively refer to the upper and lower pinch roll assemblies of any pair of vertically-aligned and adjacent pinch roll assemblies.

Tube 90 is made of a ferrous or non-ferrous material, including, but not limited to, one or more of steel and stainless steel. Tube 90 is sized and shaped for a tight-tolerance fit inside tube 85 of body 81. In some embodiments, a high-temperature, anti-seize compound, including, but not limited to, grease, may be used to keep tubes 85 and 90 from rusting and/or corroding together when tube 90 is fit inside tube 85.

As a material to be dried is conveyed through a dryer, such as dryer 10, seal strip 82 of baffle 80 wears and the air seal established between seal strip 82 and the respective dryer roller is compromised. In the case of dryer 10, this allows gases containing V.O.C. to escape the dryer and/or ambient air to enter the dryer. To restore the air seal, baffle 80 may be mechanically removed from dryer 10 and seal strip 82 may be adjusted or replaced.

An input end dryer panel (substantially equivalent to input end dryer panel 11 shown in FIGS. 1, 4, and 5) is absent from FIGS. 1, 4, and 5 to demonstrate how baffle 80 may be removed from or inserted into dryer 10. In operation, the input end dryer panel may be secured to input end 12 of dryer 10 in a substantially equivalent manner as input end dryer panel 11 to seal dryer 10 and prevent the inflow and/or outflow of gases.

To adjust or replace seal strip 82, baffle 80 may be removed from a dryer, such as dryer 10, by sliding baffle 80 along tube 90 through a delivery or return plenum or manifold 19*a*, past a door post 19*b*, to outside the dryer. A support 110 (shown schematically in FIGS. 4 and 5) may be provided outside the dryer to support baffle 80 as it is removed from (or inserted into) the dryer. Once baffle 80 has been removed from the dryer, a new baffle 80 may be inserted into the dryer by sliding tube 90 through tube 85 of new baffle 80 and sliding new baffle 80 along tube 90 past door post 19*b* and through manifold 19*a*. A locking mechanism (not shown) may be provided to securely lock baffle 80 in position inside the dryer until removal is desired. Seal strip 82 of the removed baffle 80 may be adjusted or replaced from baffle 80 outside the dryer at the leisure of the operator. In this way, the normal operation of the dryer need not be interrupted (i.e. dryer operations need not be stopped) to replace or adjust seal strip 82. Any interruption to normal operation is only temporal since it takes an operator only minutes to replace a worn baffle with a new baffle. Thus, the inflow and/or outflow of gases of, for example, dryer 10 may be controlled to optimize the performance of the dryer, prevent the build-up of pitch inside the dryer, and/or prevent the outflow of gases containing V.O.C. from the dryer before treatment in an exhaust system. A panel, door, or other suitable means (not shown) may be provided to seal manifold 19*a* and prevent the inflow and/or outflow of gases from the dryer when baffle 80 has been removed from or inserted into the dryer. Persons skilled in the art will recognize that seal strip 82 may be adjusted or replaced in substantially an identical fashion where system 100 is installed in a conventional conveyor-type dryer.

To facilitate movement of baffle 80 along tube 90, at least one guide 120, such as a roller or any other suitable means conventionally known, may be provided. In some embodiments, the at least one guide 120 is attached to the dryer frame proximate to upper end 83 and/or lower end 84 of baffle 80 at a first end 86 and/or a second end 87 of baffle 80 when baffle 80 is installed inside the dryer. Persons skilled in the art will recognize that the at least one guide 120 may be provided in a number of suitable arrangements to support and guide baffle 80 as it is installed on and/or removed from tube 90.

Interpretation of Terms

Unless the context clearly requires otherwise, throughout the description and the claims:

"comprise", "comprising", and the like are to be construed in an inclusive sense, as opposed to an exclusive or exhaustive sense; that is to say, in the sense of "including, but not limited to";

"connected", "coupled", or any variant thereof, means any connection or coupling, either direct or indirect, between two or more elements; the coupling or connection between the elements can be physical, logical, or a combination thereof;

"herein", "above", "below", and words of similar import, when used to describe this specification, shall refer to this specification as a whole, and not to any particular portions of this specification;

"or", in reference to a list of two or more items, covers all of the following interpretations of the word: any of the items in the list, all of the items in the list, and any combination of the items in the list;

the singular forms "a", "an", and "the" also include the meaning of any appropriate plural forms.

Words that indicate directions such as "vertical", "transverse", "horizontal", "upward", "downward", "forward", "backward", "inward", "outward", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Where a component (e.g. a substrate, assembly, device, manifold, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments described herein.

Specific examples of systems, methods, and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

We claim:

1. A baffle system for use with a dryer including at least one roller for supporting and conveying a material to be dried through the dryer, the baffle system comprising:

at least one dryer tube, each dryer tube laterally extending from a first dryer wall to a second dryer wall inside the dryer perpendicularly to a direction of travel of the material to be dried through the dryer; and a baffle removeably mountable to each dryer tube, the baffle comprising a body, a baffle tube extending lengthwise through the body and configured to receive the dryer tube therein, and at least one seal strip removeably attached to the body, wherein the baffle is removeably mounted to the dryer tube by sliding the dryer tube through the baffle tube such that the at least one seal strip is positioned in sealing engagement with the at least one roller when the baffle is removeably mounted inside the dryer.

2. A baffle system according to claim 1, wherein the baffle rests on the dryer tube when the baffle is removeably mounted inside the dryer.

3. A baffle system according to claim 2, wherein the baffle further comprises at least one baffle guide for guiding the baffle along the dryer tube when the baffle is inserted into or removed from the dryer.

4. A baffle system according to claim 1, wherein each dryer tube is vertically-aligned at one or more of an input end of the dryer, an output end of the dryer, an input end of a dryer chamber, and an output end of a dryer chamber.

5. A baffle system according to claim 1, wherein each dryer tube is attached at a first end to the first dryer wall and extends at least halfway between the first dryer wall and the second dryer wall.

6. A baffle system according to claim 5, wherein each dryer tube is attached at a second end to the second dryer wall.

7. A baffle system according to claim 1, wherein each baffle is insulated.

8. A baffle system according to claim 1, further comprising at least one dryer guide attached to the dryer for supporting and guiding each baffle when the baffle is inserted into or removed from the dryer.

9. A baffle system according to claim 1, wherein the at least one seal strip comprises a first seal strip attached to a first end of the body.

10. A baffle system according to claim 9, wherein the at least one seal strip further comprises a second seal strip attached to a second end of the body opposed to the first end.

11. A baffle system according to claim 9, wherein each dryer tube is positioned such that when the corresponding baffle is removeably mounted thereto the first seal strip is positioned in sealing engagement with the at least one roller of the dryer.

12. A baffle system according to claim 10, wherein each dryer tube is positioned between an upper pinch roll assembly of the dryer and a lower pinch roll assembly of the dryer such that when the corresponding baffle is removeably mounted thereto the first seal strip is positioned in sealing engagement with a lower pinch roller of the upper pinch roll assembly and the second seal strip is positioned in sealing engagement with an upper pinch roller of the lower pinch roll assembly.

13. A dryer comprising the baffle system according to claim 1.

14. A method of replacing a seal strip inside a dryer having at least one roller for supporting and conveying a material to be dried through the dryer, the method comprising:

removing a first baffle from the dryer by sliding the first baffle across a dryer tube extending laterally across the dryer, wherein the first baffle comprises a first baffle tube extending lengthwise through the first baffle and configured to receive the dryer tube therein; and installing a second baffle into the dryer by sliding the second baffle across the dryer tube, wherein the second baffle comprises a second baffle tube extending lengthwise through the second baffle and configured to receive the dryer tube therein.

15. A method according to claim 14, wherein the first baffle is removed from the dryer by removing the dryer tube from the first baffle tube of the first baffle and the second baffle is installed in the dryer by inserting the dryer tube into the second baffle tube of the second baffle.

16. A method according to claim 14, further comprising: removing at least one seal strip from the first baffle; and removeably attaching at least one new seal strip to the first baffle.

17. A method according to claim 14, wherein the first baffle and the second baffle comprise a single baffle and the method further comprises: removing the first baffle from the dryer by sliding the first baffle across the dryer tube extending laterally across the dryer, wherein the first baffle comprises a baffle tube extending lengthwise through the first baffle and configured to receive the dryer tube therein; removing a first seal strip from the first baffle; installing a second seal strip onto the stripped first baffle creating the second baffle; and installing the second baffle into the dryer by sliding the second baffle across the dryer tube.

18. A method according to claim 14, wherein installing the second baffle comprises positioning at least one seal strip of the second baffle in sealing engagement with the at least one roller of the dryer.

19. A method according to claim 17, further comprising adjusting at least one seal strip of the first baffle.

* * * * *